US010971839B1

(12) United States Patent
Kuo et al.

(10) Patent No.: US 10,971,839 B1
(45) Date of Patent: Apr. 6, 2021

(54) FLOATING CONNECTOR

(71) Applicant: Greenconn Corp., New Taipei (TW)

(72) Inventors: Tsung-Lung Kuo, Taipei (TW); Kun-Shen Wu, New Taipei (TW)

(73) Assignee: Greenconn Corp., New Taipei (TW)

( * ) Notice: Subject to any disclaimer, the term of this patent is extended or adjusted under 35 U.S.C. 154(b) by 0 days.

(21) Appl. No.: 16/720,006

(22) Filed: Dec. 19, 2019

(51) Int. Cl.
*H01R 12/72* (2011.01)
*H01R 12/91* (2011.01)
*H01R 13/6476* (2011.01)

(52) U.S. Cl.
CPC ..... *H01R 12/724* (2013.01); *H01R 12/91* (2013.01); *H01R 13/6476* (2013.01)

(58) Field of Classification Search
CPC ..... H01R 12/91; H01R 13/6476
See application file for complete search history.

(56) References Cited

U.S. PATENT DOCUMENTS 5,309,630 A * 5/1994 Brunker ..... H01R 12/83 29/842
5,425,658 A * 6/1995 White ..... H01R 12/721 439/637
6,997,727 B1 * 2/2006 Legrady ..... H01R 12/57 439/246
7,025,617 B2 * 4/2006 Regnier ..... H01R 13/41 439/329
7,329,154 B2 * 2/2008 Koyama ..... H01R 13/6461 439/660
7,445,502 B2 * 11/2008 Zhang ..... H01R 13/658 439/607.01
7,485,009 B1 * 2/2009 Zhu ..... H01R 13/6473 439/660
7,704,088 B2 * 4/2010 Sakamoto ..... H01R 12/57 439/246
7,744,431 B2 * 6/2010 Trout ..... H01R 13/41 439/733.1
7,837,492 B2 * 11/2010 Zhu ..... H01R 12/57 439/329
8,708,757 B2 * 4/2014 Trout ..... H01R 12/585 439/733.1
9,293,865 B2 * 3/2016 Schwandt ..... H01R 13/6476
9,634,407 B2 * 4/2017 Endo ..... H01R 12/585
(Continued)

*Primary Examiner* — Ross N Gushi
(74) *Attorney, Agent, or Firm* — Li & Cai Intellectual Property Office

(57) ABSTRACT

A floating connector and a conductive terminal thereof are provided. The conductive terminal is integrally formed as a one piece structure, and includes a contacting segment, a fixing segment, and a buffering segment having two ends respectively connected to the contacting segment and the fixing segment. A longitudinal direction of the buffering segment and a longitudinal direction of the fixing segment have a first angle there-between less than ninety degrees. The buffering segment includes a first portion connected to the contacting segment, a second portion connected to the fixing segment, and two impedance matching portions defining a buffering hole. Two opposite ends of each of the two impedance matching portions are respectively connected to the first portion and the second portion. The buffering segment is configured to provide for an electrical current to travel there-through so as to generate a capacitance effect at the two impedance matching portions.

7 Claims, 8 Drawing Sheets

(56) References Cited

U.S. PATENT DOCUMENTS

| | | | | |
|---|---|---|---|---|
| 10,320,124 | B1 * | 6/2019 | Yang | H01R 13/6474 |
| 10,566,727 | B2 * | 2/2020 | Huang | H01R 12/724 |
| 10,673,162 | B2 * | 6/2020 | Huang | H01R 12/714 |

* cited by examiner

FLOATING CONNECTOR

FIELD OF THE DISCLOSURE

The present disclosure relates to a connector, and more particularly to a floating connector and a conductive terminal thereof.

BACKGROUND OF THE DISCLOSURE

A conventional floating connector includes a housing and a plurality of conductive terminals assembled in the housing (e.g., two sides of an elastic segment of each of the conductive terminals are fixed on the housing), and the structural design of the conductive terminal in the conventional floating connector is considered only for buffering function and vibration prevention function. In other words, since the conductive terminal needs to have the buffering function and the vibration prevention function, the structural design of the conductive terminal is restricted thereby. Accordingly, the structure of the conductive terminal is difficult to be changed for signal transmission.

SUMMARY OF THE DISCLOSURE

In response to the above-referenced technical inadequacies, the present disclosure provides a floating connector and a conductive terminal thereof to effectively improve the issues associated with conventional floating connectors.

In one aspect, the present disclosure provides a floating connector, which includes an insulating housing and a plurality of conductive terminals. The insulating housing defines an insertion direction, a length direction, and a width direction, which are perpendicular to each other. The insulating housing has an insertion slot recessed from a side thereof along the insertion direction. The conductive terminals are arranged in two rows each being parallel to the length direction. The conductive terminals of one of the two rows respectively face the conductive terminals of the other one of the two rows along the width direction. Any one of the conductive terminals is integrally formed as a one piece structure, and includes a contacting segment, a fixing segment, and a buffering segment. The contacting segment is inserted into the insulating housing and is partially arranged in the insertion slot. The fixing segment is configured to fix to an external object. The buffering segment has two opposite ends respectively connected to the contacting segment and the fixing segment. A longitudinal direction of the buffering segment and a longitudinal direction of the fixing segment have a first angle there-between that is less than 90 degrees. The buffering segment includes two impedance matching portions jointly defining a buffering hole. The buffering segment is configured to provide for an electrical current to travel there-through so as to generate a capacitance effect at the two impedance matching portions. The insulating housing is movable relative to the fixing segments of the conductive terminals, so that any one of the buffering segments pressed by the movement of the insulating housing provides a return force to the insulating housing.

In one aspect, the present disclosure provides a conductive terminal of a floating connector. The conductive terminal is integrally formed as one piece structure, and includes a contacting segment, a fixing segment, and a buffering segment. The buffering segment has two opposite ends respectively connected to the contacting segment and the fixing segment. A longitudinal direction of the buffering segment and a longitudinal direction of the fixing segment have a first angle there-between that is less than 90 degrees. The buffering segment includes a first portion connected to the contacting segment, a second portion connected to the fixing segment, and two impedance matching portions. Two opposite ends of each of the two impedance matching portions are respectively connected to the first portion and the second portion. The two impedance matching portions of the buffering segment jointly define a buffering hole. The buffering segment is configured to provide for an electrical current to travel there-through so as to generate a capacitance effect at the two impedance matching portions.

Therefore, the conductive terminal or the floating connector in the present disclosure can have a buffering (and vibration prevention) function and a signal adjusting function by forming the buffering segment with the specific structure (e.g., the two impedance matching portions jointly defining the buffering hole, and the first angle being less than 90 degrees).

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
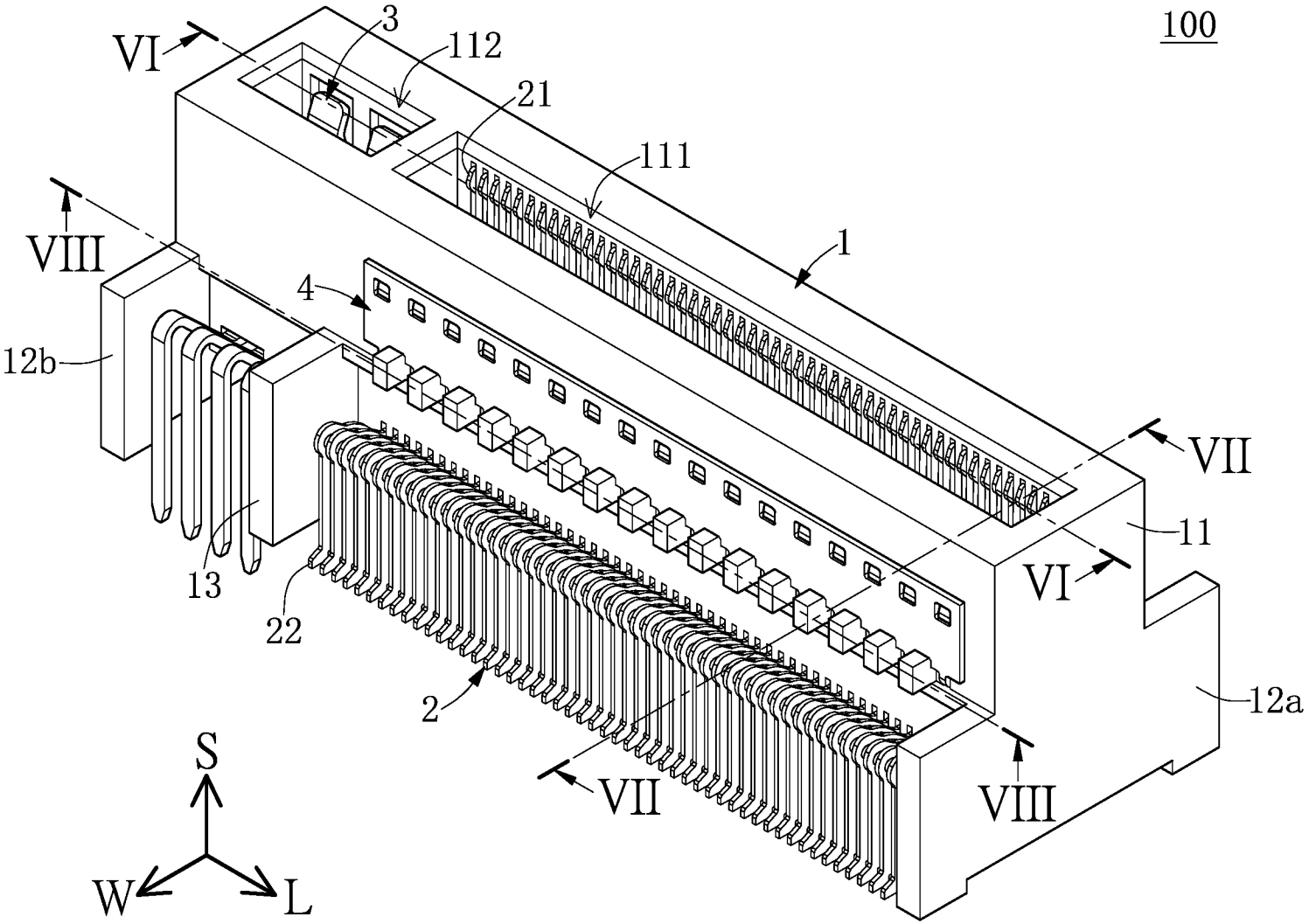
FIG. 1 is a perspective view of a floating connector according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
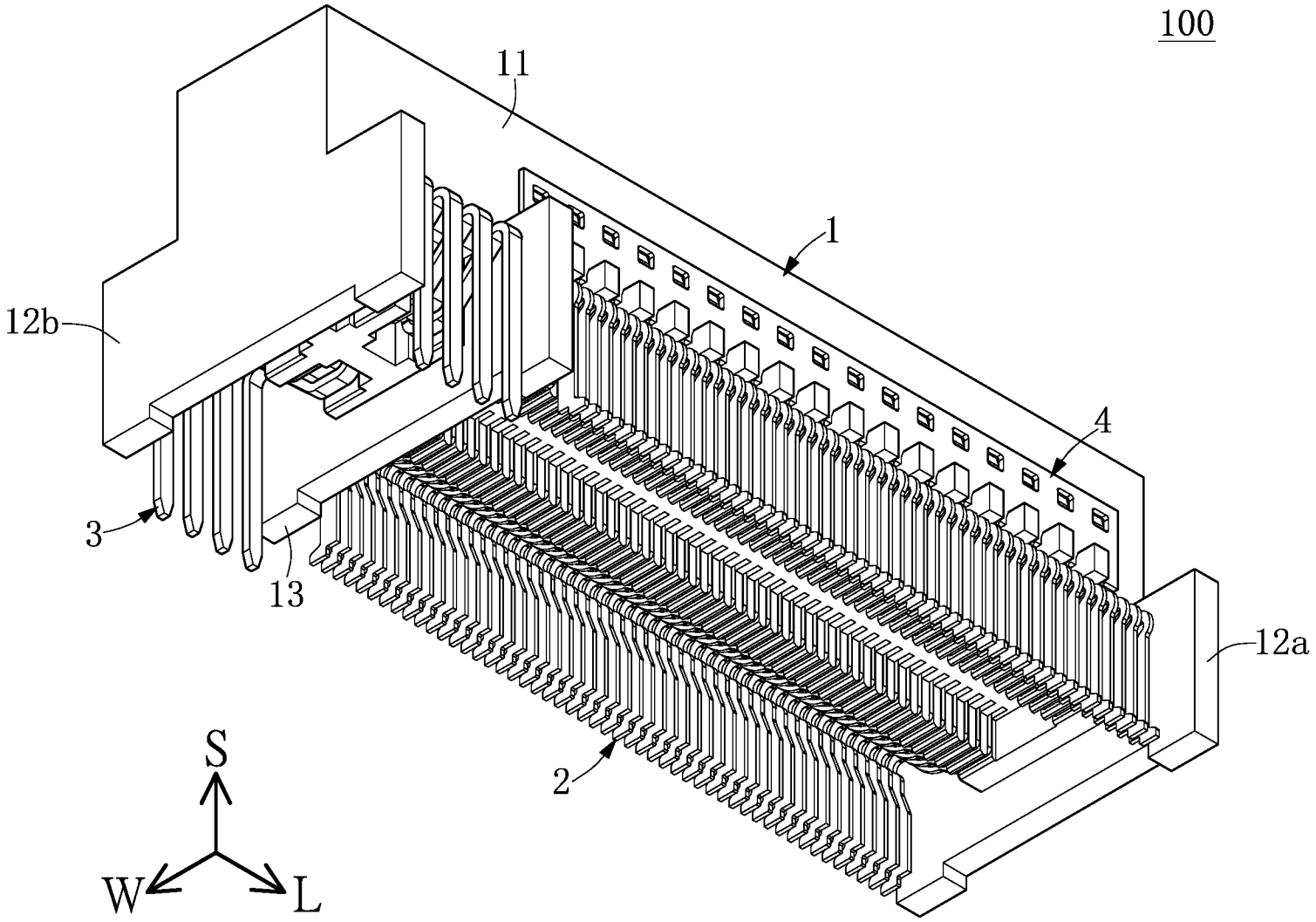
FIG. 2 is a perspective view of the floating connector from another angle of view according to the present disclosure.

Referring to FIG. 1 to FIG. 8, an embodiment of the present disclosure provides a floating connector 100. As shown in FIG. 1 and FIG. 2, the floating connector 100 is provided for being inserted with a mating connector (not shown) along an insertion direction S and being applied to a movable object (e.g., a vehicle). When the floating connector 100 is moved relative to the mating connector, the floating connector 100 can maintain a stable electrical connection with the mating connector.

Figure 3:
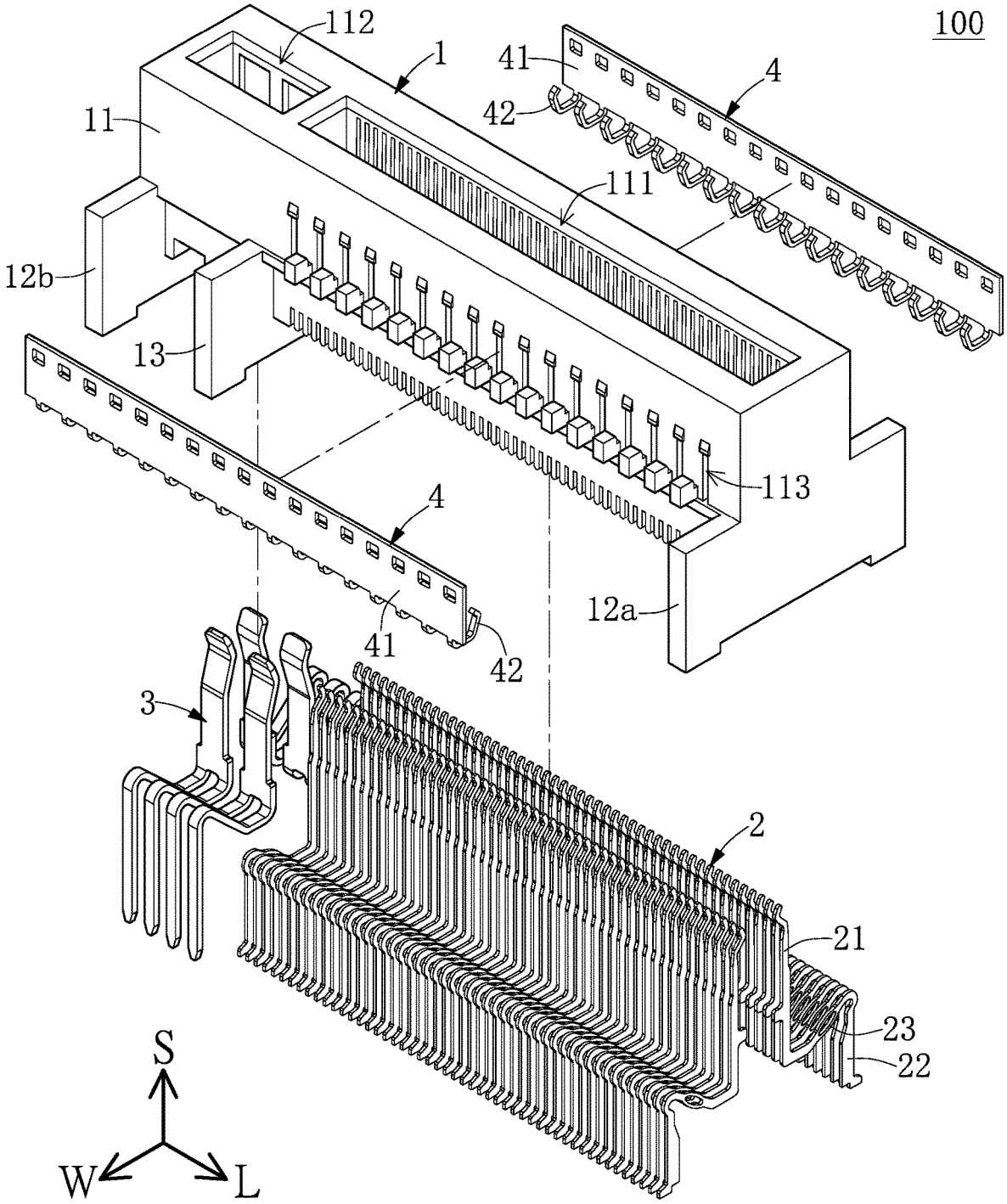
FIG. 3 is an exploded view of FIG. 1.
Figure 4:
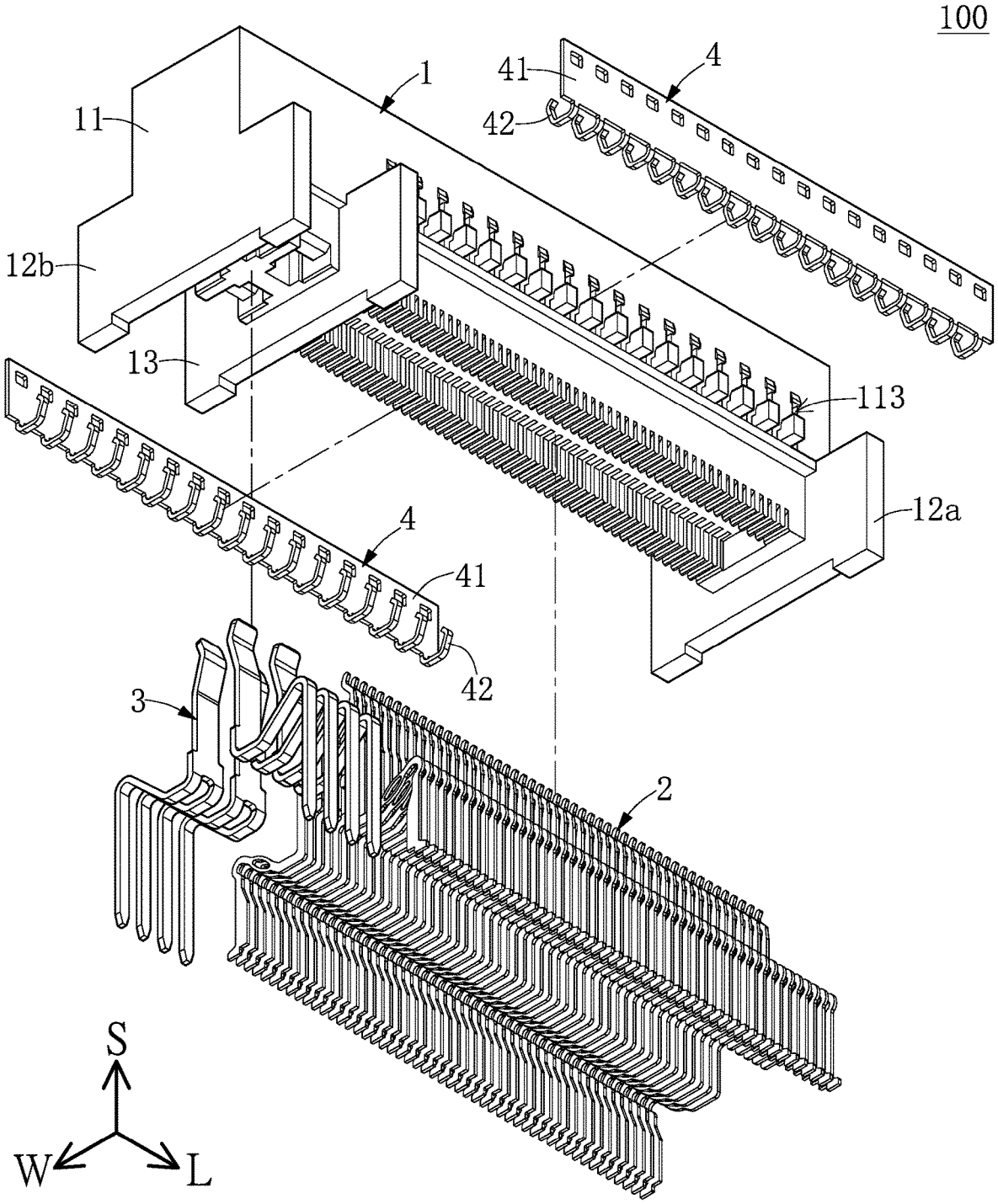
FIG. 4 is an exploded view of FIG. 2.

As shown in FIG. 3 and FIG. 4, the floating connector 100 in the present embodiment includes an insulating housing 1, a plurality of conductive terminals 2 inserted into the insulating housing 1, a plurality of power terminals 3 inserted into the insulating housing and arranged at one side of the conductive terminals 2, and two grounding bridges 4 disposed on outer surfaces of the insulating housing 1. The insulating housing 1 further defines a length direction L and a width direction W, which are perpendicular to each other and are perpendicular to the insertion direction S, for the purpose of demonstrating the relative positioning of the components of the floating connector 100. In other words, the length direction L in the present embodiment is parallel to a longitudinal direction of the insulating housing 1.

It should be noted that the floating connector 100 in the present embodiment includes the power terminals 3 and the two grounding bridges 4, but the present disclosure is not limited thereto. For example, in other embodiments of the present disclosure, the power terminals 3 and/or the two grounding bridges 4 can be selectively provided in the floating connector 100 according to design requirements. Moreover, the conductive terminal 2 in the present embodiment is described in cooperation with the insulating housing 1, but the present disclosure is not limited thereto. For example, in other embodiments of the present disclosure, the conductive terminal 2 can be independently used (e.g., sold) or can be used in cooperation with other components. The following description describes the structure and connection relationship of each component of the floating connector 100.

As shown in FIG. 3 and FIG. 4, the insulating housing 1 includes an elongated insertion chamber 11, two outer partitions 12*a*, 12*b* respectively connected to two ends of the insertion chamber 11 (e.g., the left end and the right end of the insertion chamber 11 shown in FIG. 3), and an inner partition 13 that is connected to the insertion chamber 11 and that is arranged between the two outer partitions 12*a*, 12*b*. The insulating housing 1 has an insertion slot 111 and a power slot 112 which are spaced apart from each other and are recessed from a side thereof (e.g., the top side of the insertion chamber 11 shown in FIG. 3) along the insertion direction S. The insulating housing 1 (e.g., the insertion chamber 11) has a plurality of thru-holes 113 being in spatial communication with the insertion slot 111.

Specifically, a length of the insertion slot 111 in the length direction L is greater than that of the power slot 112. The thru-holes 113 are respectively arranged at two opposite sides of the insertion slot 111, and are arranged in two rows each being parallel to the length direction L. Moreover, the two outer partitions 12*a*, 12*b* and the inner partition 13 correspond in position to a lower half portion of the insertion chamber 11, and are perpendicular to the length direction L. The insertion slot 111 corresponds in position along the insertion direction S to a region between the inner partition 13 and the outer partition 12*a*, and the power slot 112 corresponds in position along the insertion direction S to a region between the inner partition 13 and the outer partition 12*b*.

Figure 5:
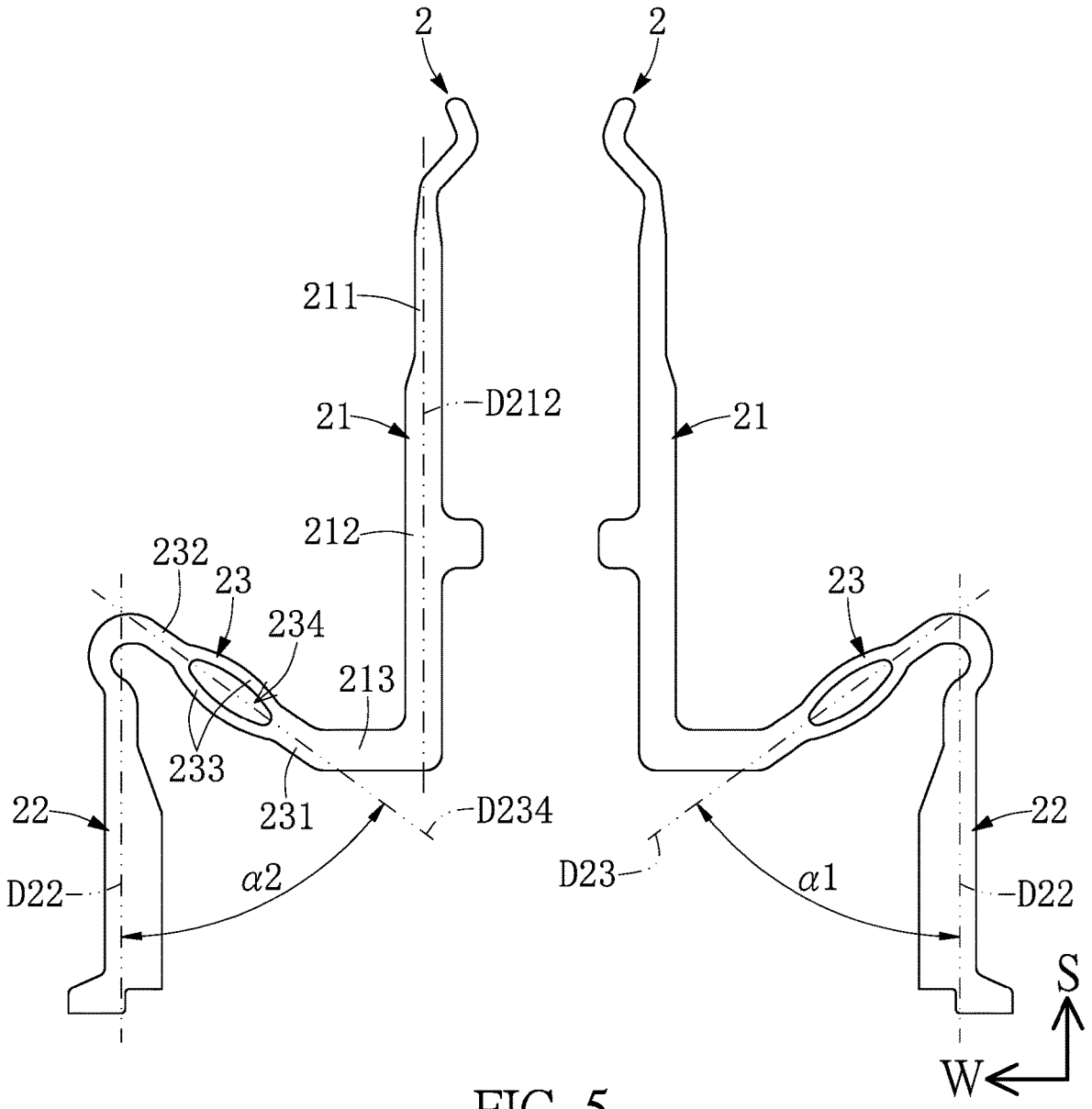
FIG. 5 is a planar view of a pair of conductive terminals of the floating connector according to the present disclosure.
Figure 6:
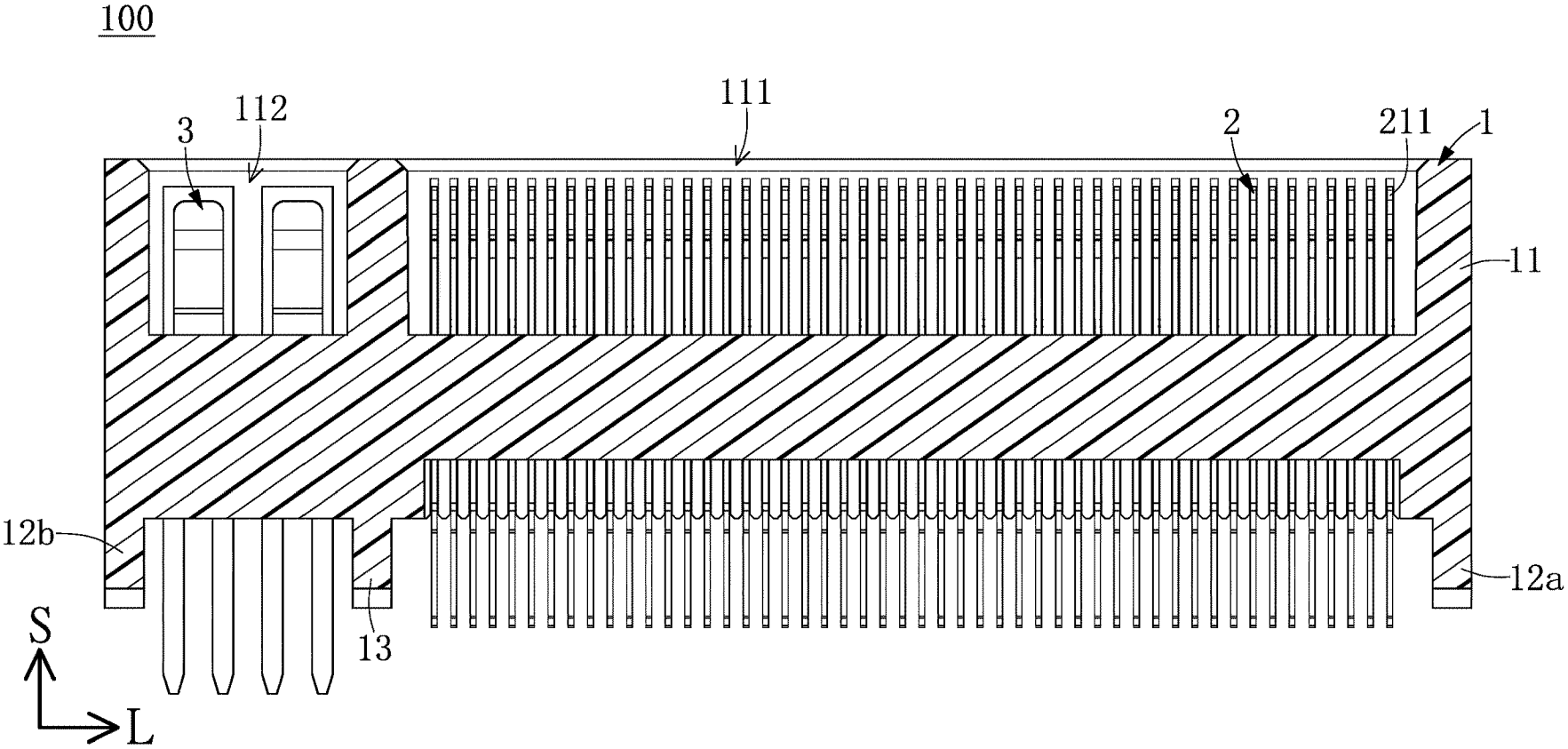
FIG. 6 is a cross-sectional view taken along line VI-VI of FIG. 1.
Figure 7:
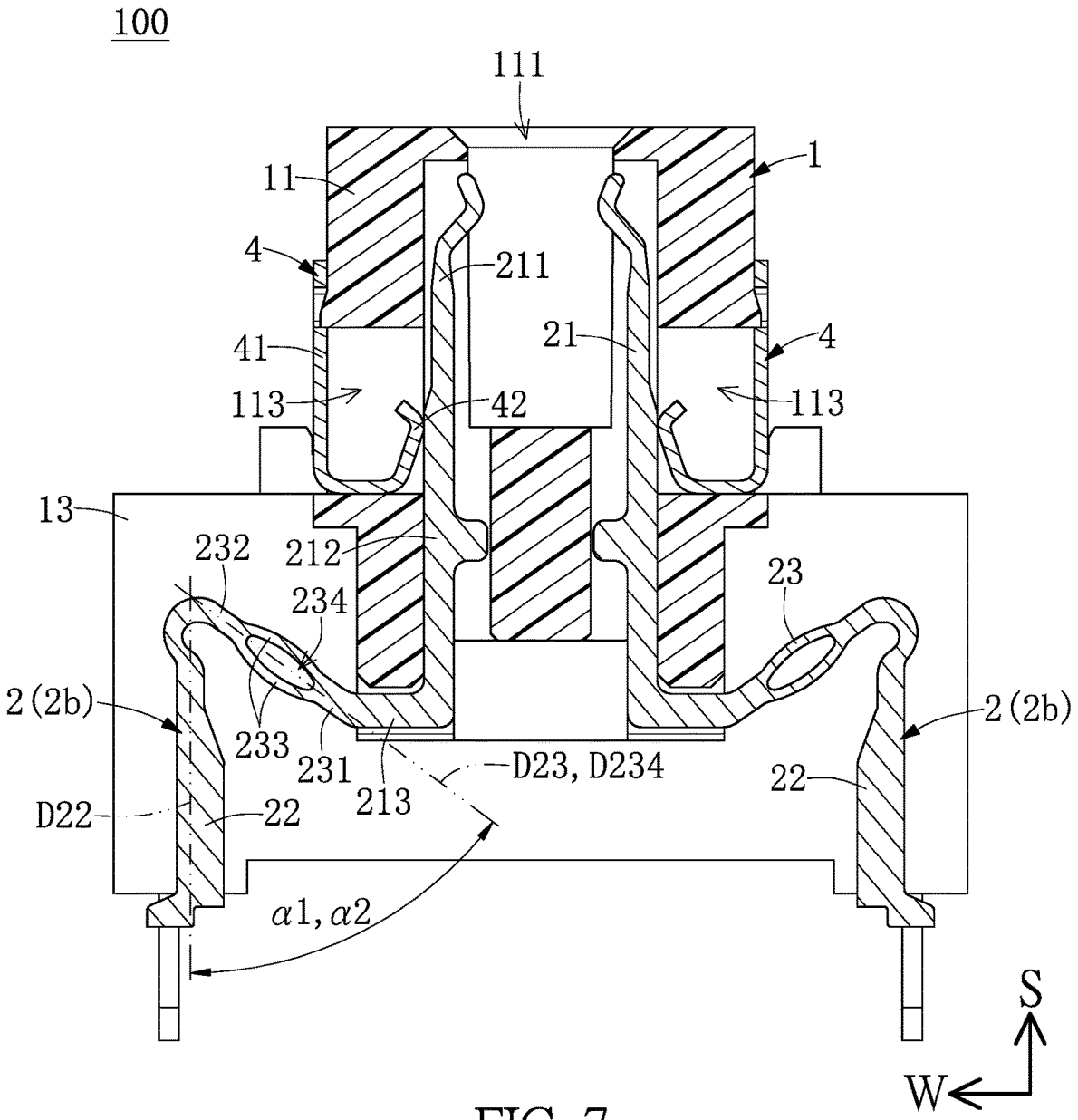
FIG. 7 is a cross-sectional view taken along line VII-VII of FIG. 1.

As shown in FIG. 5 to FIG. 7, the conductive terminals 2 are assembled to the insulating housing 1 (e.g., the conductive terminals 2 are assembled to a portion of the insertion chamber 11 corresponding in position to the insertion slot 111), the power terminals 3 are assembled to the insulating housing 1 (e.g., the power terminals 3 are assembled to a portion of the insertion chamber 11 corresponding in position to the power slot 112), and the conductive terminals 2 are separated from the power terminals 3 through the inner partition 13.

The conductive terminals 2 are arranged in two rows each being parallel to the length direction L, and the conductive terminals 2 of one of the two rows respectively face the conductive terminals 2 of the other one of the two rows along the width direction W. The two rows of the conductive terminals 2 in the present embodiment are mirror-symmetrical with respect to the insertion slot 111, but the present disclosure is not limited thereto. For example, in other embodiments of the present disclosure, the two rows of the conductive terminals 2 can be not mirror-symmetrical with respect to the insertion slot 111.

As the conductive terminals 2 are of the same structure, the following description discloses the structure of just one of the conductive terminals 2 and a corresponding portion of the insulating housing 1 for the sake of brevity. However, in other embodiments of the present disclosure, the conductive terminals 2 can be different.

The conductive terminal 2 is integrally formed as a one piece structure, and includes a contacting segment 21, a fixing segment 22, and a buffering segment 23 that has two opposite ends respectively connected to the contacting segment 21 and the fixing segment 22. The contacting segment 21 is in a substantially elongated shape, and is inserted into the insertion chamber 11 of the insulating housing 1. The fixing segment 22 and the buffering segment 23 are exposed from the insulating housing 1, and are substantially arranged between the inner partition 13 and the outer partition 12*a*.

A front portion 211 of the contacting segment 21 is formed as an elastic arm, and is arranged in the insertion slot 111. In other words, the front portion 211 of the contacting segment 21 is preferably not in contact with the insulating housing 1. A middle portion 212 of the contacting segment 21 is engaged with the insertion chamber 11 for supporting the movement of the front portion 211. A rear portion 213 of the contacting segment 21 curvedly extends from the middle portion 212 to a bottom of the insertion chamber 11, and is substantially parallel to the width direction W.

The fixing segment 22 is in a substantially elongated shape. A longitudinal direction D22 of the fixing segment 22 is substantially parallel to the insertion direction S, and is substantially parallel to a longitudinal direction D212 of the front portion 211 and the middle portion 212 of the contacting segment 21. A tail end of the fixing segment 22 is provided for being mounted onto an external object (e.g., a circuit board), and the tail end of the fixing segment 22 in the present embodiment is a structure for being soldered by using the surface mounting technology (SMT), but the present disclosure is not limited thereto.

The buffering segment 23 slantingly extends from the rear portion 213 of the contacting segment 21 along an upward direction away from the insertion chamber 11, and an angle between the buffering segment 23 and the rear portion 213 is greater than 90 degrees and less than 180 degrees. A longitudinal direction D23 of the buffering segment 23 and the longitudinal direction D22 of the fixing segment 22 have a first angle α1 there-between that is less than 90 degrees. The first angle α1 is preferably within a range of 15-75 degrees, but the present disclosure is not limited thereto.

Moreover, the buffering segment 23 in the present embodiment includes a first portion 231 connected to (the rear portion 213 of) the contacting segment 21, a second portion 232 connected to the fixing segment 22, and two impedance matching portions 233. The two impedance matching portions 233 of the buffering segment 23 jointly define a buffering hole 234, and two opposite ends of each of the two impedance matching portions 233 are respectively connected to the first portion 231 and the second portion 232. In other words, the buffering hole 234 is surroundingly defined by the two impedance matching portions 233. In addition, in other embodiments of the present disclosure, the buffering segment 23 can include only the two impedance matching portions 233, and two opposite ends of each of the two impedance matching portions 233 are respectively connected to the contacting segment 21 and the fixing segment 22.

In the present embodiment, the two impedance matching portions 233 of the buffering segment 23 are mirror-symmetrical with respect to the buffering hole 234. The buffering hole 234 can be in an elongated shape, a longitudinal direction D234 of the buffering hole 234 and the longitudinal direction D22 of the fixing segment 22 have a second angle α2 there-between that is less than ninety degrees, and a difference between the first angle α1 and the second angle α2 is less than or equal to 10 degrees. Preferably, the longitudinal direction D234 of the buffering hole 234 overlaps with the longitudinal direction D23 of the buffering segment 23; in other words, the first angle α1 is equal to the second angle α2, but the present disclosure is not limited thereto.

Specifically, the buffering segment 23 is configured to provide for an electrical current to travel there-through so as to generate a capacitance effect at the two impedance matching portions 233. In other words, according to a formula: the square of the characteristic impedance multiplied by the capacitance value is equal to the inductance value ($R^2C=L$), the inductance value of the conductive terminal 2 will change along with any changes in the length of the conductive terminal 2. Accordingly, in order to cope with the changing of the length of the conductive terminal 2, the conductive terminal 2 in the present embodiment uses the two impedance matching portions 233 to generate the capacitance effect for adjusting or reducing the characteristic impedance.

Moreover, a bottom of each of the conductive terminals 2 (i.e., a bottom of the fixing segment 22) and a bottom of each of the power terminals 3 in the present embodiment are provided to protrude from a bottom of the insulating housing 1. Accordingly, when the bottoms of the conductive terminals 2 and the power terminals 3 are fixed onto an external object (e.g., a circuit board), the insulating housing 2 is movable relative to the fixing segments 22 of the conductive terminals 2, and any one of the buffering segments 23 pressed by the movement of the insulating housing 1 can provide a return force to the insulating housing 1.

Therefore, the conductive terminal 2 in the present embodiment can have a buffering (and vibration prevention) function and a signal adjusting function by forming the buffering segment 23 with the specific structure (e.g., the two impedance matching portions 233 jointly defining the buffering hole 234, and the first angle α1 being less than 90 degrees), so that the floating connector 100 can be used to transmit high frequency (or high speed) signals through the conductive terminals 2.

Figure 8:
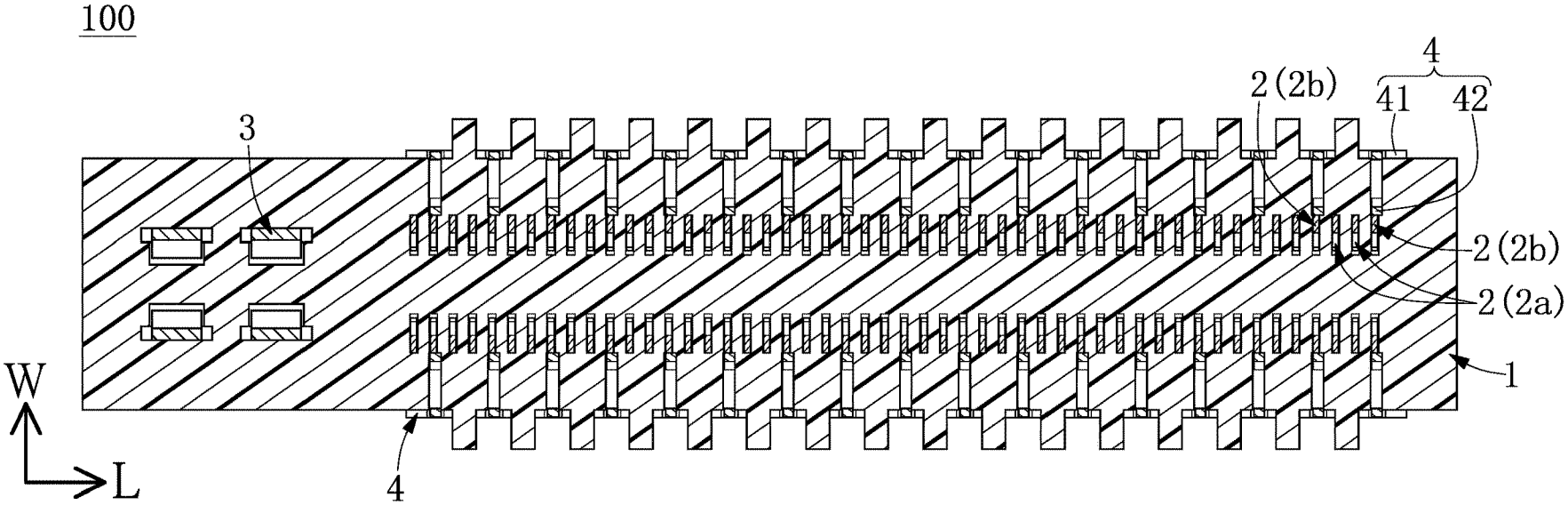
FIG. 8 is a cross-sectional view taken along line VIII-VIII of FIG. 1.

The structure of the conductive terminal 2 of the present embodiment has been disclosed in the above description, and the conductive terminals 2 of the present embodiment can be defined as a plurality of signal terminals 2*a* and a plurality of ground terminals 2*b* (shown in FIG. 8). In other words, the structure of the signal terminal 2*a* or the ground terminal 2*b* is identical to that of the conductive terminal 2. The middle portions 212 of the contacting segments 21 of the ground terminals 2*b* respectively correspond in position to the thru-holes 113.

As shown in FIG. 3, FIG. 4, and FIG. 7, the two grounding bridges 4 are respectively disposed on two opposite surfaces of the insulating housing 1. Each of the two grounding bridges 4 has a sheet 41 and a plurality of elastic arms 42 that extend from a long edge of the sheet 41 and are spaced apart from each other. The sheet 41 of each of the two grounding bridges 4 is engaged with an outer surface of the insertion chamber 11 of the insulating housing 1. The elastic arms 42 of the two grounding bridges 4 respectively pass through the thru-holes 113 to be respectively abutted against the middle portions 212 of the contacting segments 21 of the ground terminals 2*b*.

In conclusion, the conductive terminal or the floating connector in the present disclosure can have a buffering (and vibration prevention) function and a signal adjusting function by forming the buffering segment with the specific structure (e.g., the two impedance matching portions jointly defining the buffering hole, the first angle being less than 90 degrees, and the first angle and the second angle having a relative relationship), so that the floating connector can be used to transmit high frequency (or high speed) signal through the conductive terminals.

Moreover, the floating connector of the present disclosure can be provided with the power terminals for achieving different design requirements. Furthermore, the floating connector of the present disclosure can be provided with the two grounding bridges electrically coupled to the ground terminals thereof, thereby effectively improving a common ground effect.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A floating connector, comprising:

an insulating housing defining an insertion direction, a length direction, and a width direction, which are perpendicular to each other, wherein the insulating housing has an insertion slot recessed from a side thereof along the insertion direction; and a plurality of conductive terminals arranged in two rows each being parallel to the length direction, wherein the conductive terminals of one of the two rows respectively face the conductive terminals of the other one of the two rows along the width direction, and any one of the conductive terminals is integrally formed as a one piece structure and includes:

a contacting segment inserted into the insulating housing and partially arranged in the insertion slot;

a fixing segment configured to fix to an external object; and a buffering segment having two opposite ends respectively connected to the contacting segment and the fixing segment, wherein a longitudinal direction of the buffering segment and a longitudinal direction of the fixing segment have a first angle there-between that is less than 90 degrees, wherein the buffering segment includes two impedance matching portions jointly defining a buffering hole, and wherein the buffering segment is configured to provide for an electrical current to travel there-through so as to generate a capacitance effect at the two impedance matching portions, wherein the insulating housing is movable relative to the fixing segments of the conductive terminals, so that any one of the buffering segments pressed by the movement of the insulating housing provides a return force to the insulating housing.

2. The floating connector according to claim 1, wherein in any one of the conductive terminals, the buffering hole is in an elongated shape, a longitudinal direction of the buffering hole and the longitudinal direction of the fixing segment have a second angle there-between that is less than 90 degrees, and a difference between the first angle and the second angle is less than or equal to 10 degrees.

3. The floating connector according to claim 1, wherein in any one of the conductive terminals, the buffering hole is in an elongated shape, and a longitudinal direction of the buffering hole overlaps with the longitudinal direction of the buffering segment.

4. The floating connector according to claim 1, wherein in any one of the conductive terminals, the buffering segment includes a first portion connected to the contacting segment and a second portion connected to the fixing segment, two opposite ends of each of the two impedance matching portions are respectively connected to the first portion and the second portion, and the two impedance matching portions of the buffering segment are mirror-symmetrical with respect to the buffering hole.

5. The floating connector according to claim 1, wherein in any one of the conductive terminals, the fixing segment and the contacting segment are exposed from the insulating housing.

6. The floating connector according to claim 1, wherein the two rows of the conductive terminals are mirror-symmetrical with respect to the insertion slot.

7. The floating connector according to claim 1, wherein the insulating housing has a plurality of thru-holes being in spatial communication with the insertion slot, the conductive terminals are defined as a plurality of signal terminals and a plurality of ground terminals, and the contacting segments of the ground terminals respectively correspond in position to the thru-holes, and wherein the floating connector includes two grounding bridges respectively disposed on two opposite surfaces of the insulating housing, each of the two grounding bridges has a plurality of elastic arms spaced apart from each other, and the elastic arms of the two grounding bridges respectively pass through the thru-holes to be respectively abutted against the contacting segments of the ground terminals.

* * * * *